US011987420B2

(12) United States Patent
Klump et al.

(10) Patent No.: US 11,987,420 B2
(45) Date of Patent: May 21, 2024

(54) SKID ASSEMBLY FOR AN APPLIANCE

(71) Applicant: Haier US Appliance Solutions, Inc., Wilmington, DE (US)

(72) Inventors: James M. Klump, Louisville, KY (US); Eric Matthew Lewis, Louisville, KY (US); Elizabeth Ann Sherzer, Louisville, KY (US); David Osbourne, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 209 days.

(21) Appl. No.: 17/685,714

(22) Filed: Mar. 3, 2022

(65) Prior Publication Data

US 2023/0278752 A1 Sep. 7, 2023

(51) Int. Cl.

| | |
|---|---|
| ***B65D 19/44*** | (2006.01) |
| ***B65D 19/00*** | (2006.01) |
| ***B65D 19/40*** | (2006.01) |
| ***B65D 81/05*** | (2006.01) |

(52) U.S. Cl.

CPC ..... *B65D 19/44* (2013.01); *B65D 19/0095* (2013.01); *B65D 19/40* (2013.01); *B65D 81/054* (2013.01); *B65D 2519/00019* (2013.01); *B65D 2519/00034* (2013.01); *B65D 2519/00054* (2013.01); *B65D 2519/00064* (2013.01); *B65D 2519/00069* (2013.01); *B65D 2519/00079* (2013.01); *B65D 2519/00273* (2013.01); *B65D 2519/00293* (2013.01); *B65D 2519/00323* (2013.01); *B65D 2519/00333* (2013.01); *B65D 2519/00562* (2013.01);

(Continued)

(58) Field of Classification Search

CPC .... B65D 19/00; B65D 19/0095; B65D 19/40; B65D 19/44; B65D 81/05; B65D 81/054; B65D 85/30; B65D 2519/00019; B65D 2519/00034; B65D 2519/00054; B65D 2519/00064; B65D 2519/00069; B65D 2519/00079; B65D 2519/00273; B65D 2519/00293; B65D 2519/00323; B65D 2519/00333; B65D 2519/00562; B65D 2519/00815; B65D 2585/6817; B65D 2585/682; B65D 2585/6855

USPC .... 206/320, 386, 595–600; 108/51.11–57.34

See application file for complete search history.

(56) References Cited

U.S. PATENT DOCUMENTS 5,970,885 A 10/1999 Polando
6,126,002 A * 10/2000 Brown ..... B65D 19/14 206/320

(Continued)

FOREIGN PATENT DOCUMENTS

DE 102020206810 B3 8/2021

*Primary Examiner* — Bryon P Gehman
(74) *Attorney, Agent, or Firm* — Dority & Manning, P.A.

(57) ABSTRACT

A packaging assembly for a home appliance includes a base frame including a first plank and a second plank provided parallel to the first plank, and a pair of spring clips attached to the base frame. The pair of spring clips includes a right spring clip attached to a top surface of the first plank, and a left spring clip attached to a top surface of the second plank, wherein an axial extension direction of the right spring clip is parallel to an axial extension direction of the left spring clip, and wherein the pair of springs are configured to selectively accept a base rail of the home appliance therein.

18 Claims, 3 Drawing Sheets

(52) U.S. Cl.
CPC ..... *B65D 2519/00815* (2013.01); *B65D 2585/6817* (2013.01); *B65D 2585/682* (2013.01); *B65D 2585/6855* (2013.01)

(56) References Cited

U.S. PATENT DOCUMENTS

| | | | | |
|---|---|---|---|---|
| 7,543,703 | B2 * | 6/2009 | Brittain | B65D 85/30 206/320 |
| 7,648,026 | B2 * | 1/2010 | Brittain | B65D 85/30 206/320 |
| 10,414,543 | B2 | 9/2019 | Chezem | |

* cited by examiner

SKID ASSEMBLY FOR AN APPLIANCE

FIELD OF THE INVENTION

The present subject matter relates generally to home appliances, and more particularly to skid assemblies for home appliances.

BACKGROUND OF THE INVENTION

Skid assemblies are used to support and cushion appliances during product assembly, storage, and transport. Exemplary appliances include refrigerators, freezers, dishwashers, stoves, washers, and dryers. Many other objects may also benefit from the use of skid assemblies during product assembly, storage, and transport, such as large industrial machines, machining equipment, and cabinetry.

During product assembly, for example, appliances are generally moved from one assembly station to the next, transported along conveyors, and stacked one on top of another. Conventional pallets, carriers, and skids typically require the appliances to be secured thereto via fasteners, for example. Typically, bolts, screws, or other mechanical means are used to attach the appliance to the pallet, carrier, or skid. For instance, screws can be fastened to a bracket of an appliance. When removing the pallet, carrier, or skid from the appliance, the appliance is typically laid on its side or up against another object so that the bolts, screws, or other mechanical means can be unfastened. Laying the appliance on its side or against another object can damage the appliance or object, especially where the appliance is prone to surface damage and dents.

Accordingly, an improved skid assembly that obviates one or more of the above-mentioned drawbacks would be beneficial. In particular, a skid assembly allowing an appliance to be easily secured and detached therefrom would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a packaging assembly for a home appliance is provided. The packaging assembly may include a base frame including a first plank and a second plank provided parallel to the first plank, and a pair of spring clips attached to the base frame, the pair of spring clips defining an axial direction, a radial direction, and a circumferential direction. The pair of spring clips may include a right spring clip attached to a top surface of the first plank, and a left spring clip attached to a top surface of the second plank, wherein an axial extension direction of the right spring clip is parallel to an axial extension direction of the left spring clip, and wherein the pair of spring clips define a receiving channel complementary to a base rail of the home appliance to receive the base rail therein.

In another exemplary aspect of the present disclosure, a packaged appliance is provided. The packaged appliance may include a cabinet defining a volume, a base rail attached to the cabinet, and a skid assembly selectively coupled to the base rail. The skid assembly may include a base frame including a first plank and a second plank provided parallel to the first plank, and a pair of spring clips attached to the base frame, the pair of spring clips defining an axial direction, a radial direction, and a circumferential direction. The pair of spring clips may include a right spring clip attached to a top surface of the first plank, and a left spring clip attached to a top surface of the second plank, wherein an axial extension direction of the right spring clip is parallel to an axial extension direction of the left spring clip, and wherein the pair of spring clips define a receiving channel complementary to a base rail of the home appliance to receive the base rail therein.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
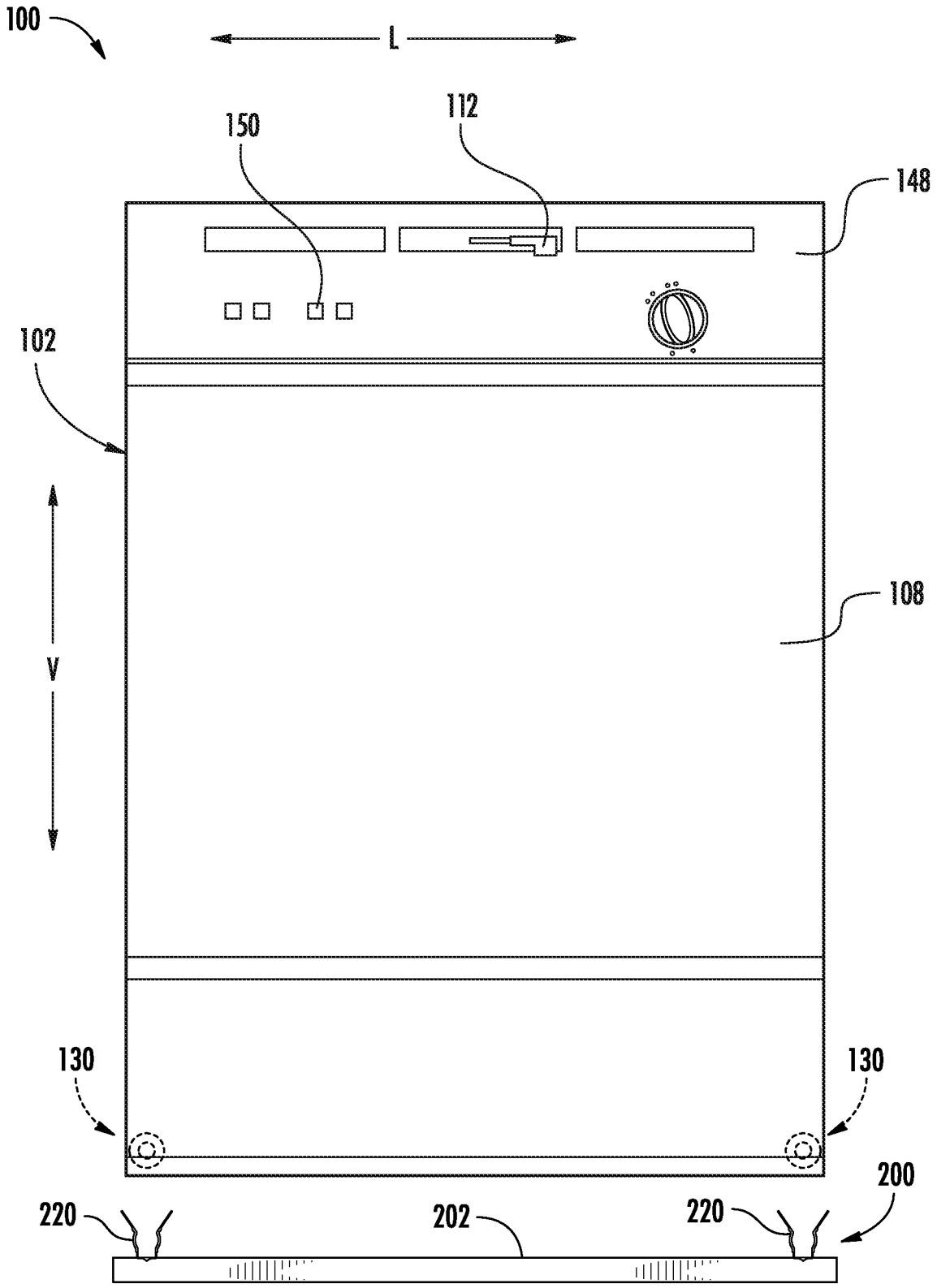
FIG. 1 provides a front view of a dishwasher appliance with a skid assembly according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Turning now to the figures, FIG. 1 illustrates an exemplary embodiment of a domestic dishwashing appliance 100 and a corresponding skid assembly 200 that may be configured in accordance with aspects of the present disclosure. As shown in FIG. 1, the dishwashing appliance 100 may include a cabinet 102 defining an interior volume (e.g., a tub defining a wash chamber). The tub may generally include a front opening (not shown) and a door 108 hinged at its bottom for movement between a normally closed vertical position (shown in FIG. 1), wherein the wash chamber is sealed shut for washing operation, and a horizontal open position for loading and unloading of articles from the dishwasher. Optionally, a latch 112 may be used to lock and unlock the door 108 for access to the chamber 106.

Generally, the dishwashing appliance 100 may define a discrete vertical direction V, lateral direction L, and transverse direction T. Vertical direction V, lateral direction L, and transverse direction T are orthogonally oriented such that vertical direction V, lateral direction L, and transverse direction T form an orthogonal directional system. Dishwashing appliance 100 may include a controller 150 for controlling one or more washing operations therein. For example, controller 150 is disposed within a front face of door within a control panel 148. Dishwashing appliance 100 is described herein, however it should be understood that the present disclosure may apply to any suitable appliance, including washing machines, refrigerators, ovens, and the like. Moreover, a detailed thorough description of the appliance or appliances themselves will be foregone for the sake of brevity.

Dishwashing appliance 100 may be configured to be selectively attached to a skid assembly 200 (e.g., for transportation, storage, etc.). For instance, dishwashing appliance 100 may include one or more base rails 130 attached to or provided as a portion of cabinet 102 (or to a frame of the appliance). Base rails 130 may extend along the transverse direction T (e.g., between a front and a rear of the appliance 100). Base rails 130 may be selectively connected to spring clips (described below) that are fixed to skid assembly 200. Skid assembly 200 may provide additional support, stability, and protection against damage to dishwashing appliance 100.

Figure 2:
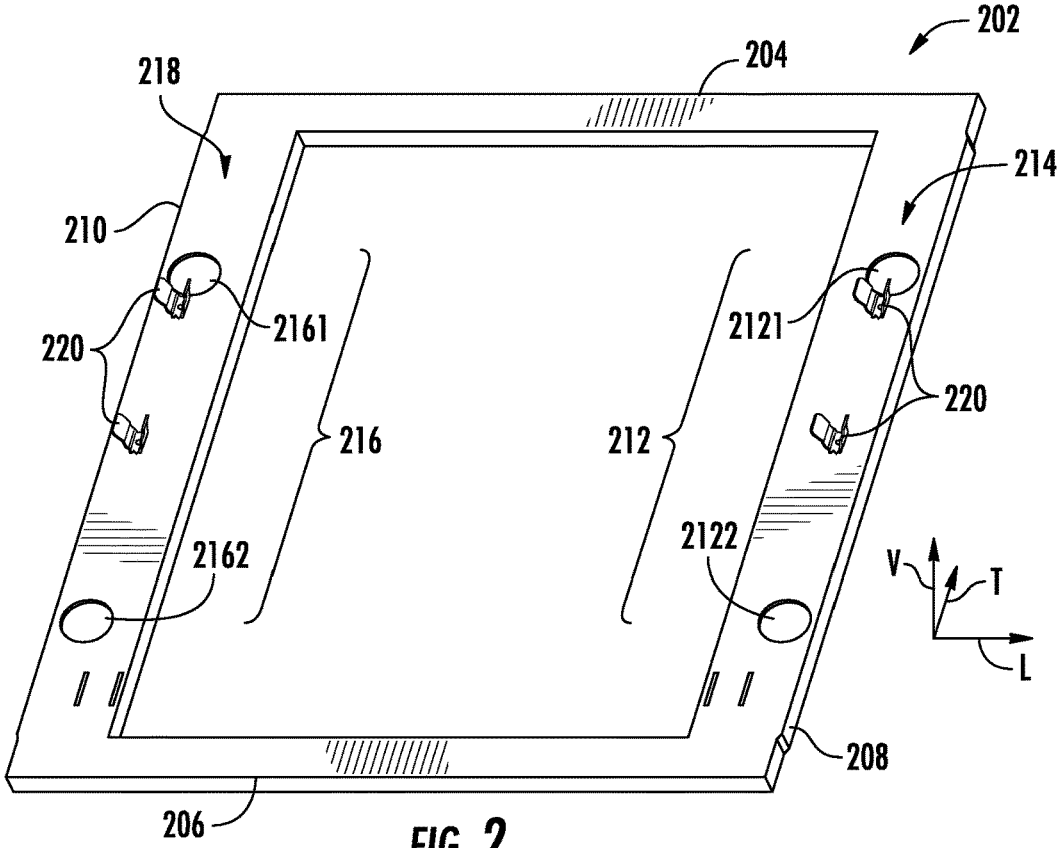
FIG. 2 provides a perspective view of the skid assembly of FIG. 1 according to exemplary embodiments of the present disclosure.

Skid assembly 200 may include a base frame 202. According to at least some embodiments, base frame 202 includes at least one solid wood plank (e.g., sawed, non-composite, timber piece that is flat, elongated, and rectangular with parallel faces). In detail, with reference to FIG. 2, base frame 202 may include a plurality of planks connected to each other. As seen in FIG. 2, four planks may be connected to form a generally rectangular frame. However, base frame 202 may be formed from a single piece, or more than four pieces, as particular applications warrant. For instance, four or more wood studs (such as 2×4s, for example) may be interconnected (e.g., via fasteners, adhesives, braces, or the like) to form base frame 202.

Base frame 202 may include a rear transverse plank 204, a front transverse plank 206, a right lateral plank 208, and a left lateral plank 210. Rear transverse plank 204 and front transverse plank 206 may be parallel to each other and spaced apart along the transverse direction T. Similarly, right lateral plank 208 and left lateral plank 210 may be parallel to each other and spaced apart along the lateral direction L. Additionally or alternatively, the pair of transverse planks 204 and 206 may be perpendicular to the pair of lateral planks 208 and 210. Base frame 202 may define a height along the vertical direction V. According to at least some embodiments, the height of base frame 202 is between about 1.5 inches and about 3 inches. Thus, an overall height of base frame 202 and the attached appliance 100 may be kept to a minimum, allowing multiple units (of appliances 100 and base frames 202) to be stacked on top of one another in storage to utilize a maximum amount of space available.

Right lateral plank 208 may define a first pair of countersinks 212. In detail, the first pair of countersinks 212 may include a first countersink 2121 and a second countersink 2122. The first pair of countersinks 212 may be formed into a top surface 214 of right lateral plank 208. For example, a portion of right lateral plank 208 is removed (e.g., from top surface 214) to form a recess or groove therein. According to at least some embodiments, each countersink of the first pair of countersinks 212 descends to a predetermined depth into the top surface 214 of right lateral plank 208. The predetermined depth of each countersink of the first pair of countersinks 212 may be between 0.5 inches and 1 inch. For instance, a bottom of each countersink 212 may be between about 0.5 inches and about 1 inch below top surface 214. Advantageously, balancing legs provided on a bottom of an attached appliance (e.g., dishwashing appliance 100) may be accepted within the first pair of countersinks 212. According to at least some embodiments, each countersink of the pair of countersinks 212 is formed complementary to a respective balance leg of appliance 100.

First countersink 2121 and second countersink 2122 may be spaced apart along the transverse direction T. For instance, first countersink 2121 may be positioned near a junction between right lateral plank 208 and front transverse plank 206 (e.g., toward a front of right lateral plank 208 along the transverse direction T when base frame 202 is composed of separate planks pieced together). Accordingly, second countersink 2122 may be positioned near a junction between right lateral plank 208 and rear transverse plank 204 (e.g., toward a rear of right lateral plank 208 along the transverse direction T). A specific transverse spacing between the first and second countersinks 2121 and 2122 may vary according to corresponding positions of the balancing legs of the attached appliance. According to some embodiments, the first pair of countersinks 212 is aligned along the transverse direction T. In detail, each of first countersink 2121 and second countersink 2122 may be positioned at an equal lateral position on right lateral plank 208. However, according to some alternate embodiments, first countersink 2121 is positioned laterally inward from second countersink 2122. According to still another embodiment, first countersink 2121 is positioned laterally outward from second countersink 2122.

Left lateral plank 210 may define a second pair of countersinks 216. In detail, the second pair of countersinks 216 may include a first countersink 2161 and a second countersink 2162. The second pair of countersinks 216 may be formed into a top surface 218 of left lateral plank 210. For example, a portion of right lateral plank 208 is removed (e.g., from top surface 214) to form a recess or groove therein. According to at least some embodiments, each countersink of the second pair of countersinks 216 descends to a predetermined depth into the top surface 218 of left lateral plank 210. The predetermined depth of each countersink of the second pair of countersinks 216 may be between 0.5 inches and 1 inch. For instance, a bottom of each countersink 212 may be between about 0.5 inches and about 1 inch below top surface 214. Advantageously, balancing legs provided on a bottom of an attached appliance (e.g., dishwashing appliance 100) may be accepted within the second pair of countersinks 216. According to at least some embodiments, each countersink of the pair of countersinks 212 is formed complementary to a respective balance leg of appliance 100.

First countersink 2161 and second countersink 2162 may be spaced apart along the transverse direction T. For instance, first countersink 2161 may be positioned near a junction between left lateral plank 210 and front transverse plank 206. Accordingly, second countersink 2162 may be positioned near a junction between left lateral plank 210 and rear transverse plank 204. A specific transverse spacing between the first and second countersinks 2161 and 2162 may vary according to corresponding positions of the balancing legs of the attached appliance. According to some embodiments, the second pair of countersinks 216 is aligned along the transverse direction T. In detail, each of first countersink 2161 and second countersink 2162 may be positioned at an equal lateral position on left lateral plank 210. However, according to some alternate embodiments, first countersink 2161 is positioned laterally inward from second countersink 2162. According to still another embodiment, first countersink 2161 is positioned laterally outward from second countersink 2162.

Skid assembly 200 may include a pair of spring clips 220 attached to base frame 202. For example, the pair of spring clips 220 may include a right spring clip 220 attached to top surface 214 of right lateral plank 208 and a second spring clip 220 attached to top surface 218 of left lateral plank 210. A number and position of spring clips 220 may vary according to specific applications. For instance, two spring clips 220 may be attached to right lateral plank 208, and two spring clips 220 may be attached to left lateral plank 210. Spring clips 220 may be configured to accept base rails 130 of the attached appliance (e.g., dishwasher appliance 100). Hereinafter, a single spring clip 220 will be described in detail. It will be understood that this description applied to each spring clip 220 attached to base frame 202, which may be identical or, alternatively, distinct from the other spring clips 220. In detail, spring clip 220 may define an axial direction A, a radial direction R, and a circumferential direction C. According to at least some examples, axial direction A is parallel with transverse direction T (e.g., of dishwasher appliance 100, such as when dishwasher 100 is attached to skid assembly 200).

Figure 3:
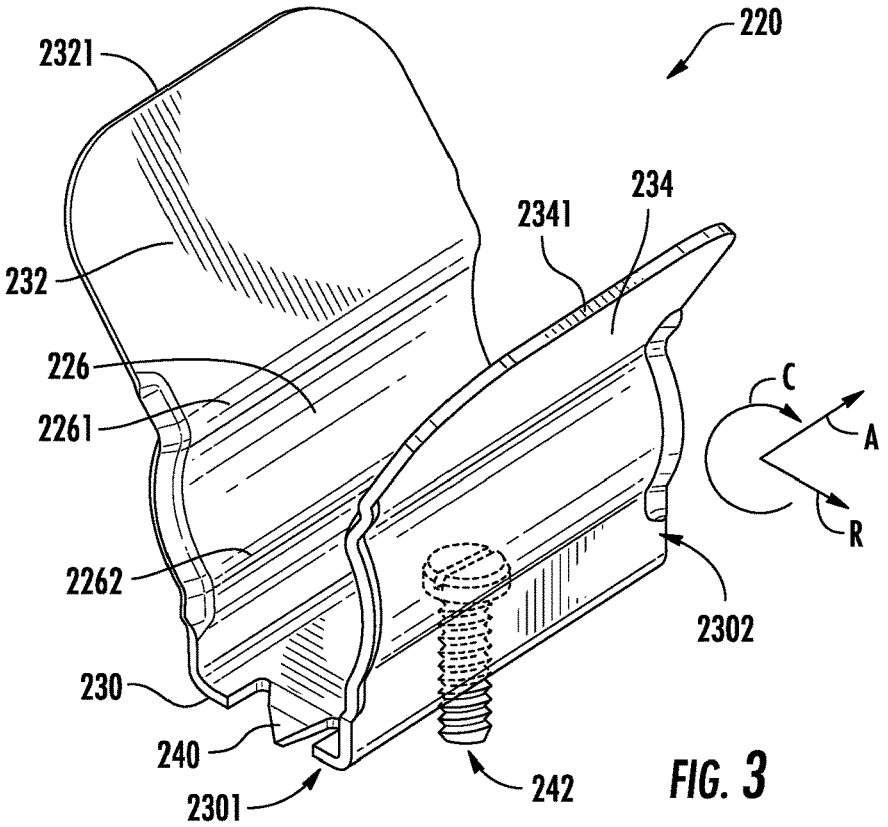
FIG. 3 provides a perspective view of a spring clip of the exemplary skid assembly of FIG. 2.
Figure 4:
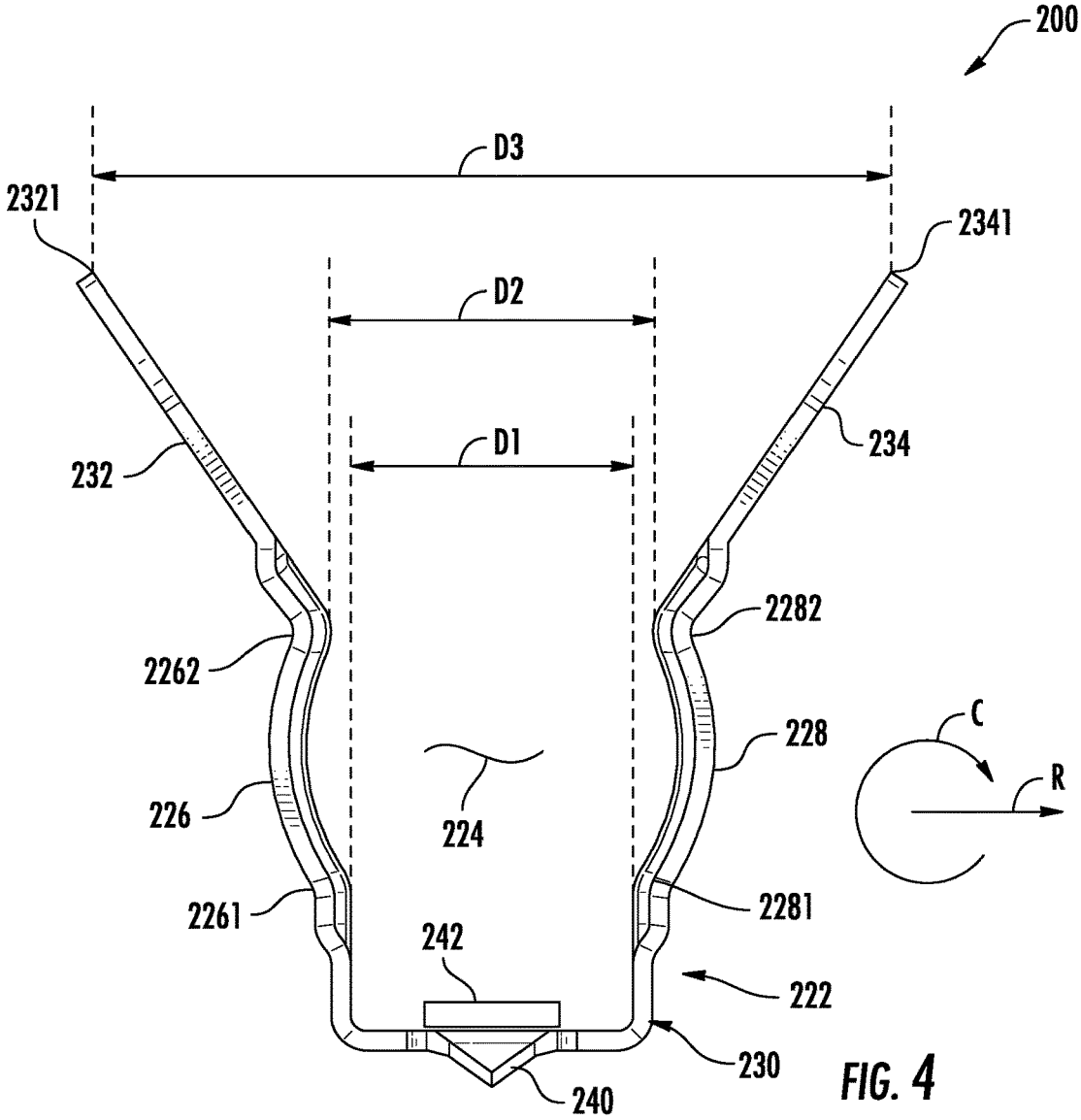
FIG. 4 provides a front view of the exemplary spring clip of FIG. 3.
Figure 5:
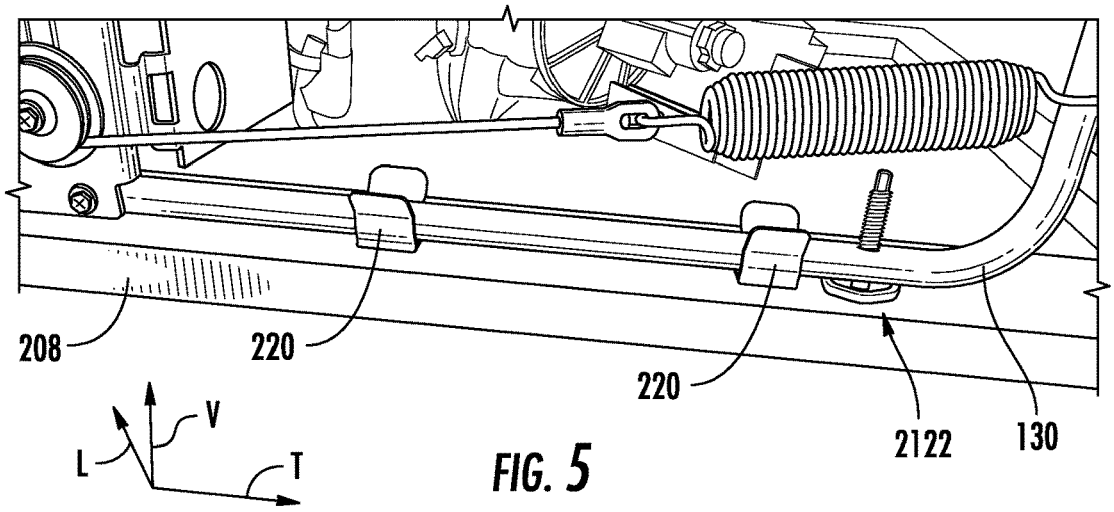
FIG. 5 provides a side perspective view of the exemplary dishwasher appliance and skid assembly of FIG. 1 with a base rail attached to the spring clips.

Spring clip 220 may include a receiving portion 222. Receiving portion 222 may define a receiving channel 224. Receiving channel 224 may be complementary to base rail 130 of the attached appliance (e.g., as a negative void match to at least a portion of base rail 130). As shown in FIGS. 3 and 4, receiving channel 224 may be at least partially tubular shaped. Spring clip 220 may be orientated such that the axial direction A of receiving channel 224 coincides with the extension direction of base rail 130. Accordingly, base rail 130 may be selectively received within receiving channel (e.g., as a snap fit).

Receiving portion 222 may include a first circumferential portion 226 and a second circumferential portion 228. Additionally or alternatively, receiving portion 222 may include a base portion 230. First circumferential portion 226 may extend from base portion 230 (e.g., along the circumferential direction C). For instance, first circumferential portion 226 may be cylindrically convex radially outward. Thus, first circumferential portion 226 may correspond to base rail 130. In detail, when base rail 130 is a cylindrical tube, a degree of curvature of first circumferential portion 226 may match a degree of curvature of base rail 130. Additionally or alternatively, first circumferential portion 226 may define a proximal edge 2261 and a distal edge 2262. Proximal edge 2261 may be connected with base portion 230. Distal edge 2262 may be disposed above proximal edge 2261 (e.g., along the vertical direction V of appliance 100).

Second circumferential portion 228 may extend from base portion 230 (e.g., along the circumferential direction C). For instance, second circumferential portion 228 may be cylindrically convex radially outward. Thus, second circumferential portion 228 may correspond to base rail 130. In detail, when base rail 130 is a cylindrical tube, a degree of curvature of second circumferential portion 228 may match a degree of curvature of base rail 130. Additionally or alternatively, second circumferential portion 228 may define a proximal edge 2281 and a distal edge 2282. Proximal edge 2281 may be connected with base portion 230. Distal edge 2282 may be disposed above proximal edge 2281 (e.g., along the vertical direction V of appliance 100).

First circumferential portion 226 and second circumferential portion 228 may be concave away from each other (e.g., forming the tubular shaped receiving channel 224 therebetween). Further, a proximal distance D1 between proximal edge 2261 of first circumferential portion 226 and proximal edge 2281 of second circumferential portion 228 (e.g., along the lateral direction L of appliance 100) may be less than a distal distance D2 between distal edge 2262 of first circumferential portion 226 and distal edge 2282 of second circumferential portion 228. Moreover, an opening may be formed between each of the distal edges 2262 and 2282. The opening may be defined in the radial direction R. Thus, base rail 130 may be pressed into receiving channel 224 between distal edges 2262 and 2282.

Spring clip 220 may include a first wing 232. In detail, first wing 232 may be a first guide wing. First wing 232 may extend from distal edge 2262 of first circumferential portion 226 (e.g., along the radial direction R). An extension length of first wing 232 may vary according to specific applications. For example, an extension length (e.g., along the radial direction R) may be between about 0.5 inches and 1.5 inches.

According to at least some embodiments, first wing 232 extends laterally inward (e.g., along the lateral direction L of appliance 100, toward a center thereof). For instance, first wing 232 may define a distal edge 2321. Distal edge 2321 may be located above distal edge 2262 of first circumferential portion 226 (e.g., along the vertical direction V of appliance 100) and laterally offset from distal edge 2262 of first circumferential portion 226. Additionally or alternatively, first wing 232 may extend an entire axial length of spring clip 220.

Spring clip 220 may include a second wing 234. In detail, second wing 234 may be a second guide wing. Second wing 234 may extend from distal edge 2282 of second circumferential portion 228 (e.g., along the radial direction R). An extension length of second wing 234 may vary according to specific applications. For example, an extension length (e.g., along the radial direction R) may be between about 0.5 inches and 1.5 inches.

According to at least some embodiments, second wing 234 extends laterally outward (e.g., along the lateral direction L of appliance 100, away from a center thereof). For instance, second wing 234 may define a distal edge 2341. Distal edge 2341 may be located above distal edge 2282 of second circumferential portion 228 (e.g., along the vertical direction V of appliance 100) and laterally offset from distal edge 2282 of second circumferential portion 228. Additionally or alternatively, second wing 234 may extend an entire axial length of spring clip 220.

First wing 232 and second wing 234 may be circumferentially spaced apart from each other. For instance, an acute angle may be defined between first wing 232 and second wing 234. According to at least some embodiments, the angle between first wing 232 and second wing 234 is between about 30 degrees and about 45 degrees. Advantageously, base rail 130 may be easily located between first wing 232 and second wing 234 to be guided into receiving channel 224. Further, a distal distance D3 between distal end 2321 of first wing 232 and distal end 2341 of second wing 234 may be greater than distal distance D2.

Spring clip 220 may include a pair of tabs 240. For instance, the pair of tabs 240 may include a first tab 240 extending from a first axial end 2301 of receiving portion 222 and a second tab 240 extending from a second axial end 2302 of receiving portion 222. Each of first and second tab 240 may be identical, and so a single tab 240 will be described herein. Tab 240 may protrude from base portion 230 of receiving portion 222. In detail, tab 240 may be bent downward (e.g., along the vertical direction V of appliance 100, or along the radial direction R away from receiving channel 224). Tab 240 may be triangular shaped, having a base connected with receiving portion 222 and a tip protruding downward. Thus, tab 240 may extend into base frame 202 (e.g., right lateral plank 208 or left lateral plank 210). A protruding distance of tab 240 into base frame 202 may vary according to specific applications. Advantageously, a position and orientation of spring clip 220 may be assured.

Spring clip 220 may be attached to base frame 202 via a fastener 242. For instance, a threaded fastener such as a screw or bolt may be used to fasten spring clip 220 to base frame 202. Alternative fasteners may be used, however, such as rivets, nails, adhesives, ties, or the like. Fastener 242 may penetrate through base portion 230 of receiving portion 222. For instance, a fastener hole may be formed radially through base portion 230 (e.g., along the vertical direction V of appliance 100). The fastener may then be fed through the fastener hole and driven into base frame 202. Tabs 240 may assist in centering and steadying spring clip 220 during a fastening thereof.

As mentioned above, spring clip 220 may be provided in any suitable number so as to securely fasten dishwashing appliance 100 to skid assembly 200. In some embodiments, two a first and second right spring clip 220 are provided, and a first and second left spring clip 220 are provided (e.g., as seen in FIG. 2). The spring clips may be provided transversely between the pair of countersinks (e.g., right pair 2121, 2122 and left pair 2161, 2162). Additionally or alternatively, an axial length of spring clips 220 may vary according to applications. For at least one example, an axial length of spring clip 220 is between about 2 inches and about 4 inches. Moreover, a spacing between adjacent spring clips 220 (e.g., along the transverse direction T) may vary according to specific applications.

Spring clips 220 may be made from a spring steel. In detail, spring clips 220 may be made from a resilient metallic material capable of adjusting shape under pressure and returning to an original shape, Accordingly, as base rail 130 is pressed into spring clip 220, first and second circumferential portions 226 and 228 may flex outward. Once base rail 130 is positioned within receiving channel 224, first and second circumferential portions 226 and 228 may return to their original positions to secure base rail (and subsequently dishwasher appliance 100) in place.

According to embodiments described herein, a skid assembly for an appliance may include a base frame and a plurality of spring clips attached to the base frame. The spring clips may selectively receive a base rail of an appliance therein to be secured to the base frame. The spring clips may be made of a resilient spring steel. Accordingly, a user may easily insert and remove the appliance from the spring clips without the use of tools.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaging assembly for a home appliance, the packaging assembly comprising:

a base frame comprising a first plank and a second plank provided parallel to the first plank; and a pair of spring clips attached to the base frame, the pair of spring clips defining an axial direction, a radial direction, and a circumferential direction, wherein the pair of spring clips comprises:

a right spring clip attached to a top surface of the first plank; and a left spring clip attached to a top surface of the second plank, wherein an axial extension direction of the right spring clip is parallel to an axial extension direction of the left spring clip, and wherein the pair of spring clips together define a receiving channel complementary to a base rail of the home appliance to receive the base rail therein.

2. The packaging assembly of claim 1, wherein each spring clip of the pair of spring clips comprises:

a receiving portion having a first circumferential portion and a second circumferential portion;

a first wing extending from the first circumferential portion along the radial direction; and a second wing extending from the second circumferential portion along the radial direction.

3. The packaging assembly of claim 2, wherein the first wing and the second wing are circumferentially spaced apart from each other and define an acute angle therebetween.

4. The packaging assembly of claim 1, wherein each spring clip of the pair of spring clips comprises:

a first tab extending from a first axial end of the receiving portion into the base frame; and a second tab extending from a second axial end of the receiving portion into the base frame.

5. The packaging assembly of claim 1, further comprising a threaded fastener joining each spring clip of the pair of spring clips to the base frame.

6. The packaging assembly of claim 1, wherein the right spring clip is a first right spring clip, wherein the left spring clip is a first left spring clip, wherein the packaging assembly further comprises:

a second right spring clip spaced apart from the first right spring clip along the axial direction;

a second left spring clip spaced apart from the first left spring clip along the axial direction.

7. The packaging assembly of claim 1, wherein each spring clip of the pair of spring clips is formed of a spring steel.

8. The packaging assembly of claim 1, wherein the base frame comprises:

a first pair of countersinks formed into the top surface of the first plank; and a second pair of countersinks formed into the top surface of the second plank.

9. The packaging assembly of claim 1, wherein each of the first plank and the second plank comprises at least one solid wood plank.

10. A packaged appliance, comprising:

a cabinet defining a volume;

a base rail attached to the cabinet; and a skid assembly selectively coupled to the base rail, wherein the skid assembly comprises:

a base frame comprising a first plank and a second plank provided parallel to the first plank; and a pair of spring clips attached to the base frame, the pair of spring clips defining an axial direction, a radial direction, and a circumferential direction, wherein the pair of spring clips comprises:

a right spring clip attached to a top surface of the first plank; and a left spring clip attached to a top surface of the second plank, wherein an axial extension direction of the right spring clip is parallel to an axial extension direction of the left spring clip, and wherein the pair of spring clips together define a receiving channel complementary to a base rail of the home appliance to receive the base rail therein.

11. The packaging assembly of claim 10, wherein each spring clip of the pair of spring clips comprises:

a receiving portion having a first circumferential portion and a second circumferential portion;

a first wing extending from the first circumferential portion along the radial direction; and a second wing extending from the second circumferential portion along the radial direction.

12. The packaging assembly of claim 11, wherein the first wing and the second wing are circumferentially spaced apart from each other and define an acute angle therebetween.

13. The packaging assembly of claim 10, wherein each spring clip of the pair of spring clips comprises:

a first tab extending from a first axial end of the receiving portion into the base frame; and a second tab extending from a second axial end of the receiving portion into the base frame.

14. The packaging assembly of claim 10, further comprising a threaded fastener joining each spring clip of the pair of spring clips to the base frame.

15. The packaging assembly of claim 10, wherein the right spring clip is a first right spring clip, wherein the left spring clip is a first left spring clip, and wherein the packaging assembly further comprises:

a second right spring clip spaced apart from the first right spring clip along the axial direction; and a second left spring clip spaced apart from the first left spring clip along the axial direction.

16. The packaging assembly of claim 10, wherein each spring clip of the pair of spring clips is formed of a spring steel.

17. The packaging assembly of claim 10, wherein the base frame comprises:

a first pair of countersinks formed into the top surface of the first plank; and a second pair of countersinks formed into the top surface of the second plank.

18. The packaging assembly of claim 10, wherein each of the first plank and the second plank comprises at least one solid wood plank.

* * * * *